US010681477B1

(12) United States Patent
Ma et al.

(10) Patent No.: US 10,681,477 B1
(45) Date of Patent: Jun. 9, 2020

(54) BINAURAL HEARING AID SYSTEM COMPRISING A BILATERAL BEAMFORMING SIGNAL OUTPUT AND OMNIDIRECTIONAL SIGNAL OUTPUT

(71) Applicant: GN HEARING A/S, Ballerup (DK)

(72) Inventors: Changxue Ma, Barrington, IL (US); Andrew Burke Dittberner, Antioch, IL (US); Rob Anton Jurjen De Vries, Eindhoven (NL)

(73) Assignee: GN HEARING A/S, Ballerup (DK)

( * ) Notice: Subject to any disclaimer, the term of this patent is extended or adjusted under 35 U.S.C. 154(b) by 0 days.

(21) Appl. No.: 16/675,214

(22) Filed: Nov. 5, 2019

(51) Int. Cl.
*H04R 25/00* (2006.01)

(52) U.S. Cl.
CPC ..... *H04R 25/552* (2013.01); *H04R 25/407* (2013.01); *H04R 25/505* (2013.01); *H04R 2225/43* (2013.01)

(58) Field of Classification Search
CPC . H04B 10/1143; H04S 2420/01; H04S 1/005; H04S 5/00; H04S 7/304; H04S 3/004; G10K 11/34; H04R 25/552; H04R 25/407; H04R 25/505; H04R 2225/43
USPC ..... 381/312, 315, 23.1, 313, 328, 375
See application file for complete search history.

(56) References Cited

U.S. PATENT DOCUMENTS

2016/0066104 A1* 3/2016 Minnaar ..... H04R 25/407 381/23.1
2018/0343527 A1* 11/2018 Edwards ..... H04R 25/554

* cited by examiner

*Primary Examiner* — Norman Yu
(74) *Attorney, Agent, or Firm* — Vista IP Law Group, LLP

(57) ABSTRACT

The present disclosure relates to methods of performing bilateral processing of respective microphone signals of a left ear hearing aid and a right ear hearing aid of a binaural hearing aid system and to corresponding binaural hearing aid systems.

21 Claims, 7 Drawing Sheets

803

BINAURAL HEARING AID SYSTEM COMPRISING A BILATERAL BEAMFORMING SIGNAL OUTPUT AND OMNIDIRECTIONAL SIGNAL OUTPUT

FIELD

The present disclosure relates to methods of performing bilateral processing of respective microphone signals of a left ear hearing aid and a right ear hearing aid of a binaural hearing aid system and to corresponding binaural hearing aid systems.

BACKGROUND

Normal hearing individuals are capable of selectively paying attention to achieve speech intelligibility and to maintain situational awareness under noisy listening conditions such as restaurants, bars, concert venues etc. so-called cocktail party scenarios or sound environments. Normal hearing individuals are capable of utilizing a better-ear listening strategy where the individual focuses his or her attention on the speech signal of the ear with the best signal to noise ratio for the target talker or speaker, i.e. a desired sound source. This better-ear listening strategy can also allow for monitoring off-axis unattended talkers by cognitive filtering mechanisms, such as selective attention.

In contrast, it remains a challenging task for hearing impaired individuals to listen to a particular, desired, sound source in such noisy sound environments and at the same time maintain environmentally awareness by monitoring off-axis or unattended talkers. Hence, it is desirable to provide similar hearing capabilities to hearing impaired individuals for example by exploiting well-known spatial filtration capabilities of existing binaural hearing aid systems. However, the use of binaural hearing aid systems and associated beamforming technology often focuses on increasing or improving a signal to noise ratio (SNR) of a bilaterally or binaurally beamformed microphone signal or signals for incoming sounds at a particular target direction, often in the frontal direction of the individual, at the expense of decreasing the audibility of the unattended, often off-axis located, talkers in the sound environment. The signal to noise ratio improvement of the binaurally beamformed microphone signal is caused by a high directivity index of the binaurally beamformed microphone signal which means that sound sources placed outside a relatively narrow angular range around the selected target direction are heavily attenuated or suppressed. The narrow angular range wherein sound sources remain substantially unattenuated may extend merely +/−20-40 degrees azimuth around the target direction. This property of the binaurally beamformed microphone signal leads to an unpleasant so-called "tunnel hearing" sensation for the hearing impaired individual or patient/user where the latter loses situational awareness.

There is a need in the art for binaural hearing aid systems which provide hearing impaired individuals with improved speech intelligibility in cocktail party sound environments, or similar adverse listening conditions, but without sacrificing off-axis awareness to provide increased situational awareness relative to prior art comparable directional hearing aid systems.

U.S. Pat. No. 8,755,547 discloses a binaural beamforming method and binaural hearing aid system for enhancing the intelligibility of sounds. The method of enhancing intelligibility of sounds includes the steps of: detecting primary sounds emanating from a first direction and producing a primary signal; detecting secondary sounds emanating from the left and right of the first direction and producing secondary signals; delaying the primary signal with respect to the secondary signals; and presenting combinations of the signals to the left and right sides of the auditory system of a listener. U.S. Pat. No. 8,755,547 utilizes the precedence effect for localization dominance only.

SUMMARY

The present disclosure relates to methods of performing bilateral processing of respective microphone signals from a left ear hearing aid and a right ear hearing aid of a binaural hearing aid system and to corresponding binaural hearing aid systems. The binaural hearing aid system uses ear-to-ear wireless exchange or streaming of a plurality of monaural directional signals over a wireless communication link. The left ear or right ear hearing aid generates a bilaterally beamformed signal with a high directivity index exhibiting maximum sensitivity in a target direction, e.g. at the user's look direction, and reduced sensitivity at the respective ipsilateral sides of the left and right ear hearing aids. The opposite ear hearing aid generates a bilateral omnidirectional microphone signal at the opposite ear by mixing a pair of the monaural directional signals wherein the bilateral omnidirectional microphone signal has a omnidirectional response or polar pattern with a low directivity index and therefore substantially equal sensitivity for all sound incidence directions or azimuth angles.

The present binaural hearing aid systems exploit human cognitive capability of sound source segregation and integration to allow the hearing impaired individual to focus on a clean target signal provided by the bilaterally beamformed signal and simultaneously monitor off-axis sound sources/talkers by using the bilateral omnidirectional microphone signal.

During hearing aid fitting the user's ear with the largest hearing loss is preferably selected to receive the bilateral omnidirectional microphone signal and the user's better ear receives bilaterally beamformed signal. The respective hearing losses of the patient's or user's left and right ears may be determined by a dispenser during hearing aid fitting.

A first aspect relates to a binaural hearing aid system comprising: a first hearing aid for placement at, or in, a user's left or right ear, said first hearing aid comprising a first microphone arrangement, a first signal processor, a first bidirectional data communication interface configured for transmission and receipt of digital signals through a wireless communication link;

a second hearing aid for placement at, or in, the user's opposite ear, said second hearing aid comprising a second microphone arrangement, a second signal processor, a second bidirectional data communication interface configured for transmission and receipt of the microphone signals through the wireless communication link; wherein the first signal processor is configured to:

generate a first monaural directional signal based on one or more microphone signals supplied by the first microphone arrangement in response to incoming sound, said first monaural directional signal having a first polar pattern with maximum sensitivity in the target direction and reduced sensitivity at the ipsilateral side and contralateral side of the ear at which the first hearing aid is placed, generate a second monaural directional signal based on the one or more microphone signals supplied by the first microphone arrangement, said second monaural directional signal exhibiting a second polar pattern with substantially equal sensitivity in the target direction and at the ipsilateral side of the ear at which the first hearing aid is placed, transmitting the second monaural directional signal to the second hearing aid through the first bidirectional data communication interface, receiving a third monaural directional signal, transmitted by the second hearing aid, through the wireless communication link and first bidirectional data communication interface, generate a bilaterally beamformed signal based on the first and third monaural directional signals, said bilaterally beamformed signal having a polar pattern with maximum sensitivity in the target direction and reduced sensitivity at the ipsilateral side of the ear at which the first hearing aid is placed and reduced sensitivity at the contralateral ear, applying the bilaterally beamformed signal via an output amplifier to a miniature speaker, receiver, or stimulus electrode of the first hearing aid to generate a corresponding audible signal for the user;

and wherein the second signal processor is configured to:

receive the second monaural directional signal, transmitted by the first hearing aid, through the wireless communication link and second bidirectional data communication interface, generate the third monaural directional signal based on one or more microphone signals supplied by the second microphone arrangement in response to incoming sound, said third monaural directional signal having a third polar pattern with maximum sensitivity in the target direction and reduced sensitivity at the ipsilateral side and contralateral side of the user's opposite ear, transmitting the third monaural directional signal to the first and contralateral hearing aid through the second bidirectional data communication interface, generate a fourth monaural directional signal based on the one or more microphone signals supplied by the second microphone arrangement in response to incoming sound, said fourth monaural directional signal exhibiting a fourth polar pattern with substantially equal sensitivity in the target direction and at the ipsilateral side of the user's opposite ear, mixing the second and fourth monaural directional signals in a fixed or adjustable ratio to generate a bilateral omnidirectional microphone signal exhibiting a fifth polar pattern in accordance with the second and fourth polar patterns, applying the bilateral omnidirectional microphone signal to a miniature speaker or receiver via an output amplifier to generate a corresponding audible signal for the user.

The respective sensitivities or responses of the first, second, third, fourth and fifth polar patterns may be determined at 2 kHz using a narrowband test signal such as a sine wave. Alternatively, the respective sensitivities of the first, second, third, fourth and fifth polar patterns may be determined by 1.5 kHz-5 kHz bandlimited white noise signal. The latter measurement conditions may give more representative results of real-world performance of the binaural hearing aid system due to the averaging across a frequency range important for speech understanding. The polar pattern of the bilaterally beamformed signal may be determined in the same manner i.e. by using the 2 kHz narrowband test signal or the 1.5 kHz-5 kHz bandlimited white noise signal. Exemplary sensitivities or responses of the first, second, third, fourth and fifth polar patterns at various sound incidence angles are discussed in detail below with reference to the appended drawings.

The acoustic manikin may be a commercially available acoustic manikin such as KEMAR or HATS or any similar acoustic manikin which is designed to simulate or represent average acoustic properties of the human head and torso. The skilled person will appreciate that the the first, second, third, fourth and fifth polar patterns, and that of the bilaterally beamformed signal, typically will be about the same when the binaural hearing aid system is appropriately arranged on a hearing impaired user or patient as on the acoustic manikin. However, the reference to the acoustic manikin based determination ensures well-defined and reproducible measurement conditions.

The first and second hearing aids may be fitted to the user or hearing impaired individual such that the ear with the largest hearing loss receives the bilateral omnidirectional microphone signal and the ear with the smallest hearing loss, or best hearing ability, receives bilaterally beamformed signal. The respective hearing losses of the patient's or user's left and right ears may be determined by a dispenser in connection with hearing aid fitting using conventional means to determine the user's left ear and right ear hearing losses. In this manner, the hearing impaired individual can exploit the better-ear listening strategy where the individual focuses his or her attention on the target speaker using the ear that receives the bilaterally beamformed signal which has a good signal to noise ratio (SNR) for the target speaker due to the large attenuation of all sound sources situated outside a narrow angular range around the target direction. The bilateral omnidirectional microphone signal allows the hearing impaired individual to monitor off-axis sound sources, i.e. sound sources situated outside the narrow angular range around the target direction, using the opposite ear by cognitive filtering mechanisms, such as selective attention. The bilateral omnidirectional microphone signal reproduced to the user's other ear provides the user with good situational awareness and therefore capable of at least partly eliminating the undesired "tunnel hearing" sensation associated with traditional beamforming algorithms and binaural hearing aid systems.

According to one embodiment of the binaural hearing aid system, and of the method of performing bilateral processing of respective microphone signals from a left ear hearing aid and a right ear hearing aid, the second monaural directional signal is time delayed relative to the fourth monaural directional signal before, or during, the mixing of the second and fourth monaural directional signals. The time delay may be set to a value between 3 ms and 50 ms such as between 5 ms and 20 ms, wherein said time delay is determined at 2 kHz. The relative time delay between the second monaural directional signal and fourth monaural directional signal provides a beneficial auditory fusion between these signals by exploiting the so-called Haas effect and other advantages as discussed in additional detail below with reference to the appended drawings.

The skilled person will understand that the first signal processor of the first hearing aid may be configured to perform hearing loss compensation of the bilaterally beamformed signal before application to the user's left or right. The hearing loss compensation of the bilaterally beamformed signal may be determined based on an individually measured or determined hearing loss of the ear in question during a hearing aid fitting procedure for example at a dispenser's office. Likewise, the second signal processor of the second hearing aid may configured to perform hearing loss compensation of the bilateral omnidirectional microphone signal. The hearing loss compensation of the bilateral omnidirectional microphone signal may be determined based on an individually measured or determined hearing loss of the ear in question during the hearing aid fitting procedure.

In one embodiment, the second signal processor, or possibly first signal processor depending on which of the ear the second hearing aid is mounted, may be configured to generate the bilateral omnidirectional microphone signal by mixing the second and fourth monaural directional signals according to:

$$S=\beta*dl+(1-\beta)dr_{e2e}(t1);$$

wherein:

S: is a time-domain representation of the bilateral omnidirectional microphone signal based on a mixture of the second and fourth monaural directional signals;

dl: is a time-domain representation of the fourth monaural directional signal;

$dr_{e2e}(t1)$: is a time-domain representation of the second monaural directional signal with a relative time delay of (t1), β: is scalar scaling factor between 0 and 1 setting the mixing ratio of the second and fourth monaural directional signals or a filter to set a frequency-dependent mixing ratio of the second and fourth monaural directional signals.

In one such embodiment the second signal processor is configured to adaptively adjust the scaling factor, β, in accordance with relative powers of the second fourth monaural directional signals, for example by computing, β, in accordance with:

$$\beta = \frac{dl^2}{dl^2 + dr^2}$$

The second signal processor is configured to adaptively adjust the scaling factor, β, to maximize power of the bilateral omnidirectional microphone signal, S; or adaptively adjust coefficients of the digital filter to maximize power of the bilateral omnidirectional microphone signal S as discussed in additional detail below with reference to the appended drawings. The filter which may set the frequency-dependent mixing ratio of the second and fourth monaural directional signals may comprise a digital filter such as a FIR filter or IIR filter.

In an embodiment the scaling factor, β, comprises a linear phase FIR filter with a group delay, d and the second signal processor is configured to generate the bilateral omnidirectional microphone signal according to:

$$S=\beta*dl+(z^{-d}-\beta)dr_{e2e}(t1). \quad 1$$

In an embodiment of the binaural hearing aid system the first hearing aid comprises:

at least one housing portion shaped and sized for placement inside the user's left or right ear canal and comprising an omnidirectional microphone of the first microphone arrangement, said omnidirectional microphone having a sound inlet at an outwardly oriented surface of the least one housing portion such that the second polar pattern, of the second monaural directional signal, is at least partly formed by natural directional properties of the user's left or right pinna. The second hearing aid similarly comprises:

at least one housing portion shaped and sized for placement inside the user's opposite ear canal and comprising an omnidirectional microphone of the second microphone arrangement, said omnidirectional microphone having a sound inlet at an outwardly oriented surface of the least one housing portion such that the fourth polar pattern, of the fourth monaural directional signal, is at least partly formed by natural directional properties of the user's opposite pinna. The presence of a microphone sound inlet inside each of the user's left and right ear canals, for example on an outwardly oriented surface of an ITE, ITC, CIC, RIC housing structure of the hearing aid or ear plug in question allows the second and fourth monaural directional signals to be formed in a computationally efficient manner advantages as discussed in additional detail below with reference to the appended drawings.

According to another embodiment of the binaural hearing aid system, the first and second hearing aids comprises a BTE housing portion or section in which the first microphone and second microphone arrangements, respectively, are contained. The first hearing aid may therefore comprise:

at least one housing portion shaped and sized for placement at or behind the user's left or right ear pinna, said at least one housing portion comprising first and second omnidirectional microphones of the first microphone arrangement arranged with respective sound inlets spaced apart by a predetermined distance along the at least one housing portion; and wherein the first signal processor is configured to:

apply a first beamforming algorithm to the first and second microphone signals supplied by the first and second omnidirectional microphones to generate the first monaural directional signal, and apply a second beamforming algorithm to the first and second microphone signals supplied by the first and second omnidirectional microphones to generate the second monaural directional signal. The second hearing aid may comprise:

at least one housing portion shaped and sized for placement at or behind the user's opposite ear pinna, said at least one housing portion comprising first and second omnidirectional microphones of the second microphone arrangement arranged with respective sound inlets spaced apart by a predetermined distance along the at least one housing portion; and wherein the second signal processor is configured to:

apply a third beamforming algorithm to the first and second microphone signals supplied by the first and second omnidirectional microphones to generate the third monaural directional signal, and apply a fourth beamforming algorithm to the first and second microphone signals supplied by the first and second omnidirectional microphones to generate the fourth monaural directional signal.

According one embodiment of the binaural hearing aid system and method of performing bilateral processing of respective microphone signals from a left ear hearing aid and a right ear hearing aid, the first signal processor is configured to adaptively compute the bilaterally beamformed signal based on the first monaural directional signal and the third monaural beamforming signal using a time delay and sum mechanism; said computation comprising minimizing a cost function C(α,β) according to:

$$C(\alpha,\beta)=\{E\{(\alpha Z_l+\beta Z_r)\cdot(\alpha Z_l^*+\beta Z_r^*)\}+\lambda^*(\alpha+\beta-1)+\lambda(\alpha+\beta-1)^*$$

under the constraint α+β=1; and wherein

E represents statistical expectation, $dl_i$ represents the i-th subband of the first monaural directional signal, $dr_i$ represents the i-th subband of the third monaural directional signal; and and * indicates the conjugation of a complex function.

A second aspect relates to a method of performing bilateral processing of respective microphone signals from a left ear hearing aid and a right ear hearing aid of a wireless binaural hearing aid system to provide a bilaterally beamformed signal at a left or right ear of a hearing aid user and a bilateral omnidirectional microphone signal at the opposite ear of the hearing aid user; said method comprising:

by a first signal processor of the left or right ear hearing aid carrying out steps of:

generate a first monaural directional signal based on one or more microphone signals supplied by a first microphone arrangement of the left or right ear hearing aid in response to incoming sound, said first monaural directional signal having a first polar pattern with maximum sensitivity in the target direction and reduced sensitivity at the ipsilateral side and contralateral side of the ear at which the first hearing aid is placed, generate a second monaural directional signal based on the one or more microphone signals supplied by the first microphone arrangement, said second monaural directional signal exhibiting a second polar pattern with substantially equal sensitivity in the target direction and at the ipsilateral side of the ear at which the first hearing aid is placed, transmitting the second monaural directional signal to the second hearing aid through a wireless communication link, receiving a third monaural directional signal, transmitted by the second hearing aid, through the wireless communication link, generate a bilaterally beamformed signal based on the first and third monaural directional signals, said bilaterally beamformed signal having a polar pattern with maximum sensitivity in the target direction and reduced sensitivity at the ipsilateral side of the first hearing aid and reduced sensitivity at the contralateral ear, ipsilateral side of the second hearing aid, converting the bilaterally beamformed signal into a corresponding audible signal for the user's left or right ear; and by a second signal processor of the opposite hearing aid carrying out steps of:

receive the second monaural directional signal, transmitted by the first hearing aid, through the wireless communication link, generate the third monaural directional signal based on one or more microphone signals supplied by the second microphone arrangement in response to incoming sound, said third monaural directional signal having a third polar pattern with maximum sensitivity in the target direction and reduced sensitivity at the ipsilateral side of the user's opposite ear, transmitting the third monaural directional signal to the first and contralateral hearing aid through the second bidirectional data communication interface, generate a fourth monaural directional signal based on the one or more microphone signals supplied by the second microphone arrangement in response to incoming sound, said fourth monaural directional signal exhibiting a fourth polar pattern with substantially equal sensitivity in the target direction and at the ipsilateral side of the user's left or right ear, mixing the second and fourth monaural directional signals in a fixed or adjustable ratio to generate the bilateral omnidirectional microphone signal exhibiting a fifth polar pattern formed as a weighted sum of the second and fourth polar patterns, converting the bilateral omnidirectional microphone signal into a corresponding audible signal for the user's opposite ear.

BRIEF DESCRIPTION OF THE DRAWINGS

In the following exemplary embodiments, various features are described in more detail with reference to the appended drawings, wherein.

DETAILED DESCRIPTION OF EMBODIMENTS

Figure 1:
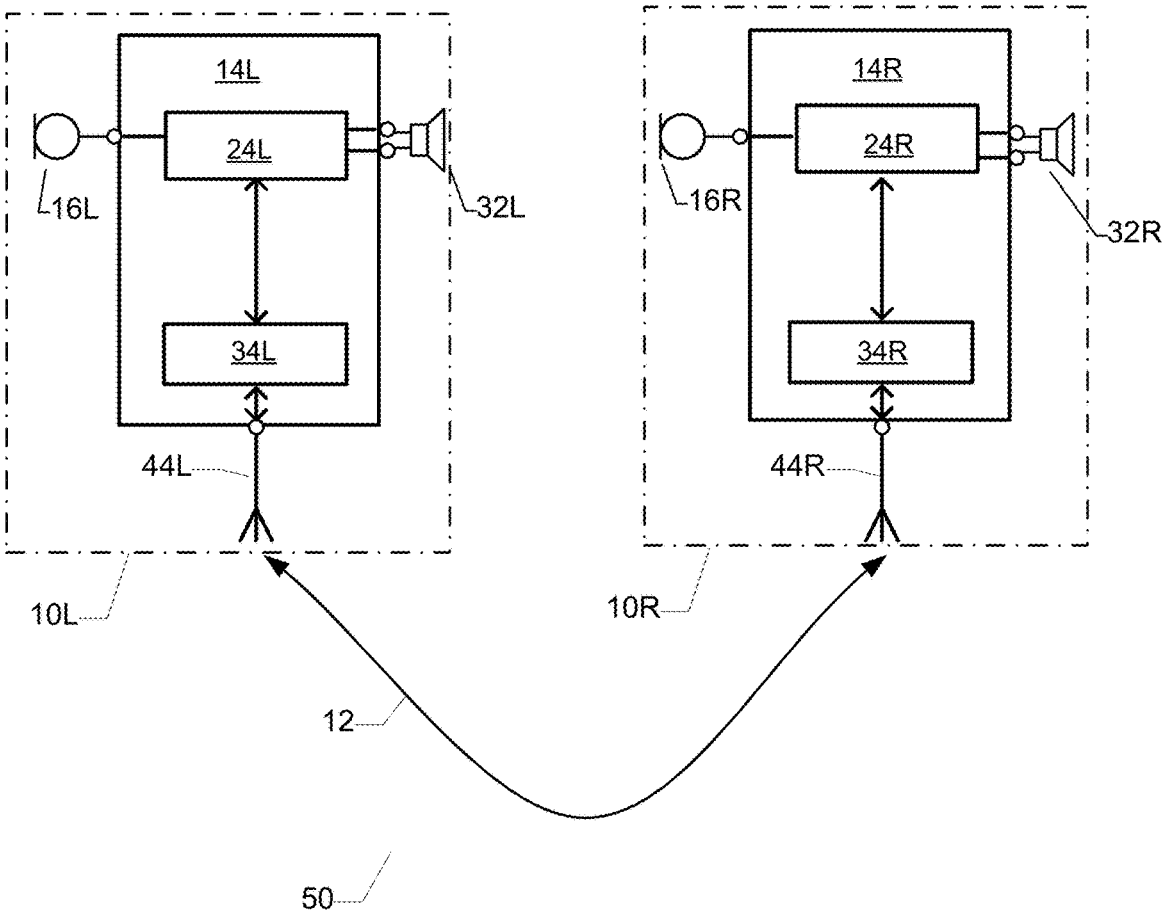
FIG. 1 schematically illustrates a binaural or bilateral hearing aid system comprising a left ear hearing aid and a right ear hearing aid connected via a bidirectional wireless data communication channel in accordance with exemplary embodiments.

Various exemplary embodiments and details of a binaural hearing aid system are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

FIG. 1 schematically illustrates a binaural or bilateral hearing aid system 50 comprising a left ear hearing aid or instrument 10L and a right ear hearing aid or instrument 10R each of which comprises a wireless communication interface for connection to the other hearing instrument In the present embodiment, the left ear and right ear hearing aids 10L, 10R are connected to each other via a bidirectional wireless data communication connection or link 12 which support real-time streaming of digitized microphone signals. A unique ID may be associated with each of the left ear and right ear hearing aids 10L, 10R. Each of the illustrated wireless communication interfaces 34L, 34R of the binaural hearing aid system 50 may be configured to operate in the 2.4 GHz industrial scientific medical (ISM) band and may be compliant with a Bluetooth LE standard. Alternatively, each of the illustrated wireless communication interfaces 34L, 34R may comprise magnetic coil antennas 44L, 44R and based on near-field magnetic coupling such as the NMFI operating in the frequency region between 10 and 20 MHz.

The left hearing aid 10L and the right hearing aid 10R may be substantially identical in some embodiments of the present hearing aid system expect for the above-described unique ID such that the following description of the features, components and signal processing functions of the left hearing aid 10L also applies to the right hearing aid 10R. The left hearing aid 10L may comprise a $ZnO_2$ battery (not shown) or a rechargeable battery that is connected for supplying power to the hearing aid circuit 14L. The left hearing aid 10L comprises a microphone arrangement 16L that preferably at least comprises first and second omnidirectional microphones as discussed in additional detail below.

The left hearing aid 10L additionally comprises a signal processor 24L that may comprise a hearing loss processor. The signal processor 24L is also configured to carry out monaural beamforming and bilateral beamforming on microphone signals of the left hearing aid and on a contralateral microphone signal as discussed in additional detail below. The hearing loss processor is configured to compensate a hearing loss of a user of the left hearing aid 10L. Preferably, the hearing loss processor 24L comprises a well-known dynamic range compressor circuit or algorithm for compensation of frequency dependent loss of dynamic range of the user often termed recruitment in the art. Accordingly, the signal processor 24L generates and outputs a bilateral beamforming audio signal with additional hearing loss compensation to a loudspeaker or receiver 32L. The loudspeaker or receiver 32L converts the electrical audio signal into a corresponding acoustic signal for transmission into left ear canal of the user.

The skilled person will understand that each of the signal processors 24L, 24R may comprise a software programmable microprocessor such as a Digital Signal Processor. The operation of the each of the left and right ear hearing aids 10L, 10R may be controlled by a suitable operating system executed on the software programmable microprocessor. The operating system may be configured to manage hearing aid hardware and software resources, e.g. including computation of the bilaterally beamformed signal, computation of the first and third monaural beamforming signals, computation of the hearing loss compensation and possibly other processors and associated signal processing algorithms, the wireless data communication interface 34L, certain memory resources etc. The operating system may schedule tasks for efficient use of the hearing aid resources and may further include accounting software for cost allocation, including power consumption, processor time, memory locations, wireless transmissions, and other resources. The operating system may control the operation of the wireless bidirectional data communication interface 34L such that a first monaural beamforming signal is transmitted to the right ear hearing aid 10R and a second monaural beamforming signal is received from the right ear hearing aid through the wireless bidirectional data communication interface 34L and communication channel 12. The right ear hearing aid 10R has the same hardware components and software components that function in a corresponding manner.

Figure 2:
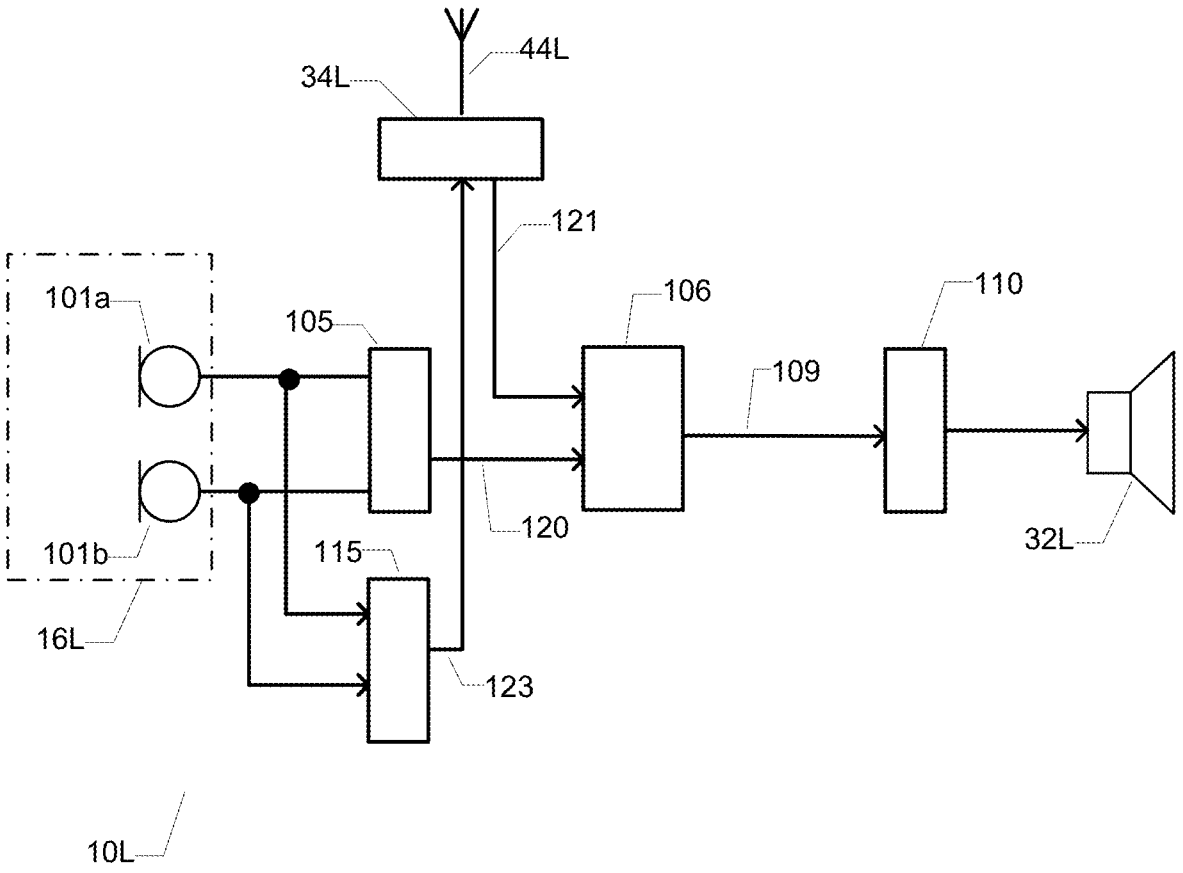
FIG. 2 shows a schematic block diagram of the left ear hearing aid of the binaural or bilateral hearing aid system in accordance with a first embodiment.

FIG. 2 is a schematic block diagram of the left ear hearing aid or instrument 10L for placement at, or in, a user's left ear, of the binaural or bilateral hearing aid system 50. The illustrated components of the left ear hearing aid 10L may be arranged inside one or several hearing aid housing portion(s) such as BTE, RIE, ITE, ITC, CIC, RIC etc. type of hearing aid housings. The hearing aid 10L comprises a microphone arrangement 16L which preferably comprises at least the above-mentioned first and second omnidirectional microphones 101*a*, 101*b* that generate first and second microphone signals, respectively, in response to incoming or impinging sound. Respective sound inlets or ports (not shown) of the first and second omnidirectional microphones 101*a*, 101*b* are preferably arranged with a certain spacing in one of the housing portions the hearing aid 10L. The spacing between the sound inlets or ports depends on the dimensions and type of the housing portion, but may lie between 5 and 30 mm. This port spacing range enables the formation of the first monaural beamforming signal by applying sum and delay function or algorithm to the first and second microphone signals. The hearing aid 10L preferably comprises one or more analogue-to-digital converters (not shown) which convert the analogue microphone signals into corresponding digital microphone signals with a certain resolution and sampling frequency before application to a first monaural beamformer 105 and to a second monaural beamformer 115.

The first monaural beamformer 105 is configured to generate a first monaural directional signal 120 for example using a sum-and-delay type of beamforming algorithm. The first monaural beamformer 105 is configured to generate the first monaural directional or beamforming signal 120 based on the digitized first and second microphone signals which beamforming signal 120 preferably has a first polar pattern with maximum sensitivity in the target direction, i.e. zero degree direction or look direction of the user, i.e. the heading as illustrated on FIG. 8. The maximum sensitivity at the target direction, or at least very close thereto, for example within an angular range from 350 degrees-10 degrees, makes the first monaural beamforming signal 120 well-suited as input signal to a bilateral beamformer 106, because the first polar pattern exhibits a reduced sensitivity relative to the maximum sensitivity to incoming sound signals arriving from the ipsilateral side of the user's left ear and from the rear hemisphere of the user's head, i.e. at sound incidence directions or angles of about 180 degrees. The relative attenuation or suppression of the sound arriving from the side and rear directions compared to the target direction may be larger than 6 dB, or larger than 10 dB, such as more than 12 dB or 15 dB, determined at 2 kHz using a narrowband test signal such as a sine wave. The response or sensitivity of the first polar pattern may exhibit the same relative attenuation of these off-axis sound signals within a broader frequency range for example as determined by a 1.5 kHz-5 kHz bandlimited white noise signal.

The second monaural beamformer 115 is configured to generate a second monaural directional signal 123 for example using a sum-and-delay type of beamforming algorithm based on the digitized first and second microphone signals supplied by the microphone arrangement 16L. The second monaural directional signal 123 has a second polar pattern with good sensitivity in the target direction and a maximum sensitivity at, or close to, the ipsilateral side of the user's left ear, determined at 2 kHz, using the azimuthal angular convention indicated on FIG. 8. This substantially equal sensitivity in the target direction and at the ipsilateral side of the user's left ear preferably means that the sensitivity of the second polar pattern varies with less than 6 dB, more preferably less than 4 dB such as less than 2 dB, for sound incidence directions or angular range between 180 degrees and 330 degrees determined at 2 kHz using a narrowband test signal such as a sine wave. The response or sensitivity of the second polar pattern may exhibit the same uniformity for the sound incidence directions between 180 degrees and 330 within a broader frequency range for example as determined by a 1.5 kHz-5 kHz bandlimited white noise signal. The second polar pattern may for example be substantially equal to the open ear directional response of KEMAR's left ear.

Figure 6A:
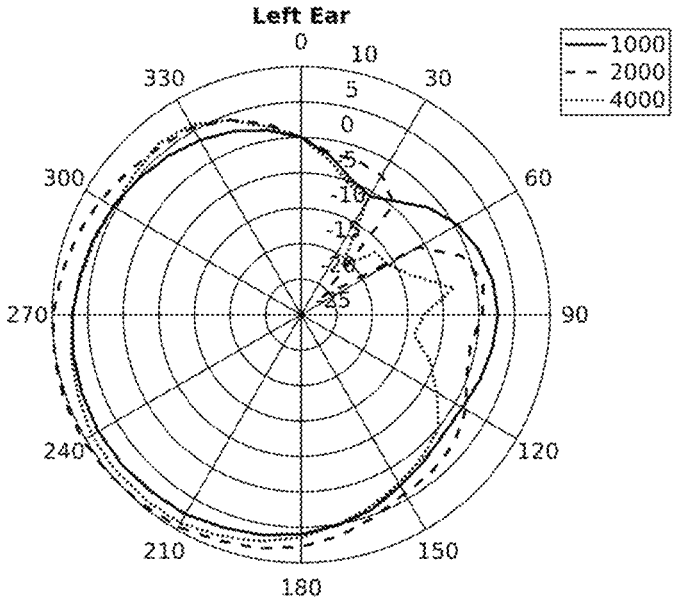
FIG. 6A shows a set of measured polar patterns of the second monaural directional signal generated by an exemplary embodiment of the second monaural beamformer at test frequencies 1, 2 and 4 kHz with the first hearing aid fitted on KEMAR's left ear.

FIG. 6A shows a set of measured second polar patterns for the second monaural directional signal 123 for one embodiment of the second monaural beamformer 115 at test frequencies 1, 2 and 4 kHz for an exemplary BTE hearing aid mounted at KEMAR's left ear. The sensitivity of the second monaural directional signal 123 in the target direction, 360 or 0 degrees, may be about 4-8 dB lower than the sensitivity in the 270 degrees direction to allow an appropriate sensitivity of the bilateral omnidirectional microphone signal, aka true-omnidirectional signal, in the target direction after mixing of the second monaural directional signal 123 and a fourth monaural directional signal as discussed below. In other words, in contrast to the first monaural directional signal 120, the second monaural directional signal 123 possess a good sensitivity for incoming sound not just from the target direction, but also from a broad angular range about the ipsilateral side of the user's left ear. The skilled person will understand that the second polar pattern preferably is designed such that the sensitivity to sounds arriving at the user's contralateral ear, right ear in the illustrated embodiment, may be significantly smaller than the sensitivity to sounds arriving from the ipsilateral side of the user's left ear, determined at 2 kHz using a narrowband test signal like a sine wave as illustrated on FIG. 6A. This difference of sensitivity may be partly caused by the acoustic shadow effect of the user's head, or by the acoustic manikin in a test situation, and therefore be particularly pronounced at higher frequencies such as 4 kHz as illustrated on FIG. 6A.

The signal processor 24L is configured to transmit the second monaural directional signal 123 to the right ear or side, i.e. contralateral, hearing aid 10R through RF or NFMI antenna 44L and bidirectional data communication interface 34L using a suitable proprietary communication protocol or standardized communication protocol supporting real-time audio. The skilled person will understand that the second monaural directional signal 123 preferably is encoded in a digital format before wireless transmission—for example a standardized digital audio format. The signal processor 24L is also configured to receive a third monaural directional signal 121 from the right ear hearing aid 10R through the bidirectional data communication interface 34L and wireless communication link 12.

The skilled person will understand that the first monaural beamformer 105 may be implemented as dedicated computational hardware integrated on the signal processor 24L or implemented by a first set of suitable executable program instructions executed on the signal processor 24L such as the previously discussed programmable microprocessor or DSP or any combination of dedicated computational hardware and executable program instructions. Likewise, the second monaural beamformer 115 may be implemented as dedicated computational hardware of the signal processor 24L or implemented by a second set of suitable executable program instructions executed on the signal processor 24L such as the previously discussed programmable microprocessor or DSP or any combination of dedicated computational hardware and executable program instructions.

The first monaural directional signal 120 and the third monaural directional signal 121, where the latter is received from the right ear hearing aid 10R, are applied to inputs of a bilateral beamformer 106 which is configured to generate a bilaterally beamformed signal 109 in response based on the first and third monaural directional signals 121, 123. The bilaterally beamformed signal having a polar pattern with maximum sensitivity in the target direction and relatively reduced sensitivity for all other sound incidence angles including at the ipsilateral side of the left ear hearing aid and at the ipsilateral side of the right ear hearing aid and at the back hemisphere of the user's head, e.g. sound incidence angles about 160-200 degrees, determined at 2 kHz using a narrowband test signal such as a sine wave. The response or sensitivity of the bilaterally beamformed signal may exhibit the same relative attenuation of these off-axis sound signals within a broader frequency range for example as determined by a 1.5 kHz-5 kHz bandlimited white noise signal. The sensitivity or response of the bilaterally beamformed signal for sound incidence at the ipsilateral side of the left ear hearing aid and at the ipsilateral side of the right ear hearing aid may be at least 10 dB such as more than 12 dB or 15 dB smaller than the sensitivity in the target direction determined at 2 kHz using the narrowband test signal.

Figure 8:
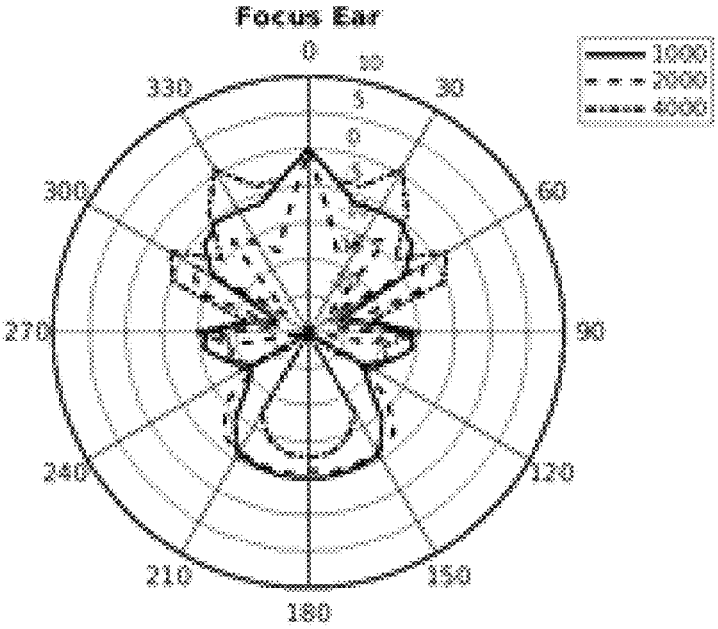
FIG. 8 shows a set of polar patterns, measured at 1 kHz, 2 kHz and 4 kHz, of the bilaterally beamformed signal generated by an exemplary embodiment of the bilateral beamformer of the first hearing aid.

The skilled person will understand that the bilateral beamformer 106 may be configured to generate the bilateral beamformed signal 109 by applying various types of fixed or adaptive beamforming algorithms known in the art such as a delay and sum beamforming algorithm or a filter and sum beamforming algorithm. An alternative embodiment of the bilateral beamformer 106 may be identical to one of the bilateral beamformers and beamforming algorithms disclosed in the assignee's co-pending application U.S. Ser. No. 16/431,690 in which the signal processor 24L is configured to adaptively compute the bilaterally beamformed signal 109 based on the first monaural directional signal 120, $Z_r$ and the third monaural directional signal 121, $Z_r$ using a time delay and sum mechanism; said computation comprising minimizing a cost function $C(\alpha,\beta)$ according to:

$$C(\alpha,\beta)=\{E\{(\alpha Z_l+\beta Z_r)\cdot(\alpha Z_l^*+\beta Z_r^*)\}+\lambda^*(\alpha+\beta-1)+\lambda(\alpha+\beta-1)^*;$$

under the constraint $\alpha+\beta=1$; E is statistical expectation and * indicates the conjugation of a complex function as discussed in additional detail in the assignee's co-pending application U.S. Ser. No. 16/431,690. FIG. 8 shows respective polar patterns of the bilateral beamforming signal 109 determined at 1 kHz, 2 kHz and 4 kHz for the above-disclosed embodiment of the bilateral beamformer 106. The polar patterns of the bilateral beamforming signal 109 are obtained by measuring its sensitivity as a function of the azimuthal angles 0-360 degrees of the test sound source. The left side and right side hearing aids are appropriately placed on KEMAR or a similar acoustic manikin which simulates average acoustic properties of the human head and torso. The test sound source may generate a broad-band test signal such as a Maximum-Length Sequence (MLS) sound signal which is reproduced at each azimuthal angle from 0 to 360 degree in steps of a predetermined size, e.g. 5 or 10 degrees. The acoustic transfer function is derived from the bilateral beamformed signal 109 and the test signal. The power spectrum of the acoustic transfer function represents a magnitude response of the bilateral beamforming signal 109 at each azimuthal angle. For adaptive beamformers and beamforming algorithms, in order to avoid over-estimating sensitivity of the beamforming signal 109 it may be advantageous to apply a Schroeder phase complex harmonic as the acoustic test sound signal in a diffuse sound field to simulate a realistic acoustic environment of the user. The magnitude spectral response may for example be estimated based on harmonics amplitude between the test sound signal playback and the bilateral beamforming signal 109 obtained in response.

The signal processor 24L may be configured to apply the bilateral beamformed signal 109 to the previously discussed conventional hearing loss function or module 110 of the left side hearing aid 10L. The conventional hearing loss processor 110 is configured to compensate a hearing loss of the user of the left hearing aid 10L and provides a hearing loss compensated output signal to the previously discussed miniature loudspeaker or receiver 32L or in the alternative to multiple output electrodes of a cochlear implant type of output stage. The conventional hearing loss processor 110 may comprise an output or power amplifier (not shown) such as a class D amplifier, e.g. digitally modulated Pulse Width Modulator (PWM) or Pulse Density Modulator (PDM) etc., to drive a miniature loudspeaker or receiver 32L, or drive a stimulus electrode of a cochlear implant device. The miniature loudspeaker or receiver 32L converts the electrical hearing loss compensated output signal into a corresponding audible signal, e.g. electrical or acoustic output signal, that can be conveyed to the user's ear drum for example via a suitably shaped and dimensioned ear plug of the left hearing aid 10L or conveyed to appropriate hearing nerves of the user.

Figure 3:
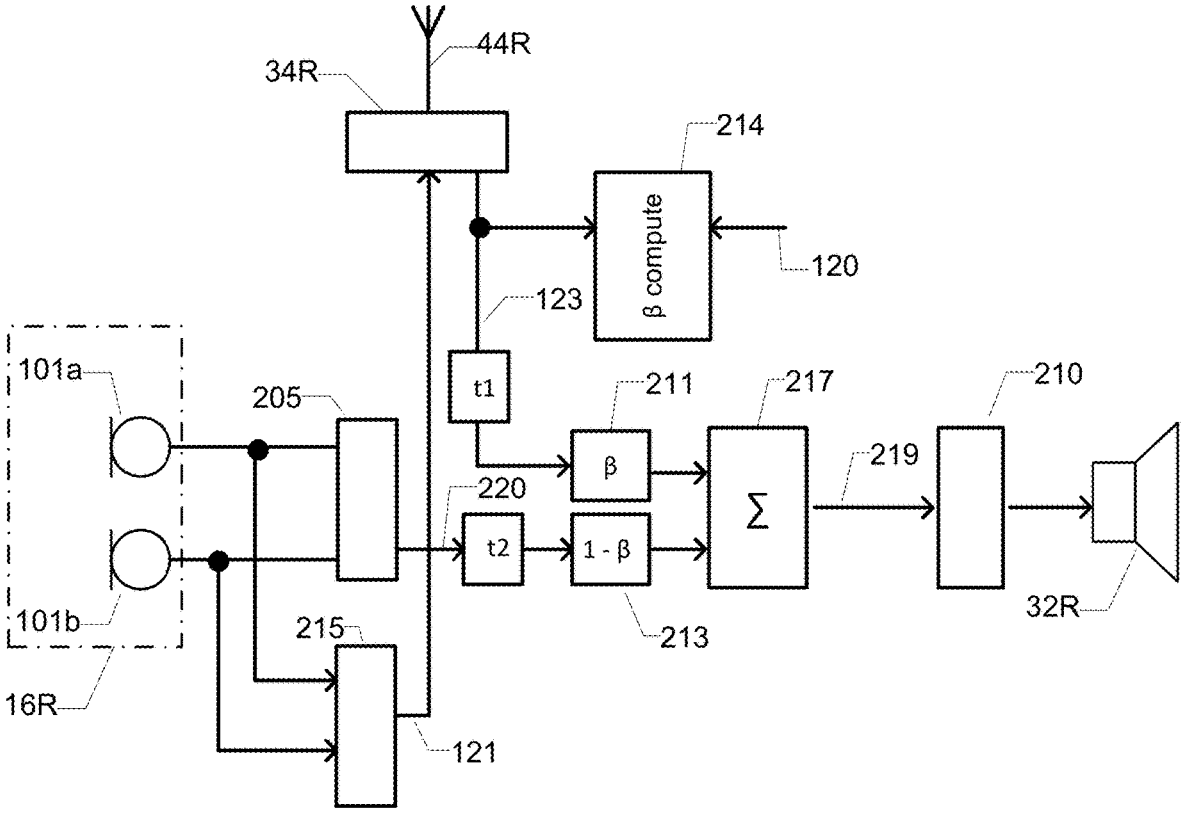
FIG. 3 shows a schematic block diagram of the right ear hearing aid of the binaural or bilateral hearing aid system in accordance with the first embodiment.

FIG. 3 is a schematic block diagram of the right ear hearing aid or instrument 10R, for placement at, or in, a user's right ear, of the binaural or bilateral hearing aid system 50. The illustrated components of the right ear hearing aid 10R may be arranged inside one or several hearing aid housing portion(s) such as BTE, RIE, ITE, ITC, CIC, RIC etc. type of hearing aid housings, preferably the same type of housing as the previously discussed left ear hearing aid. The hearing aid 10RL comprises a second microphone arrangement 16R which may be identical to the above-mentioned first microphone arrangement 16L and therefore comprise first and second omnidirectional microphones 101*a*, 101*b* as illustrated. The hearing aid 10R preferably comprises one or more analogue-to-digital converters (not shown) which convert the analogue microphone signals into corresponding digital microphone signals with a certain resolution and sampling frequency before the corresponding digitized microphone signals are applied to respective inputs of a third monaural beamformer 215 and to respective inputs of a fourth monaural beamformer 205.

The third monaural beamformer 215 is configured to generate the above-discussed third monaural directional signal 121. The third monaural beamformer 215 is configured to generate third monaural directional signal 121 for example using a sum-and-delay type of beamforming algorithm applied to the digitized first and second microphone signals supplied by the second microphone arrangement 16R. The third monaural directional signal 121 preferably has a third polar pattern with maximum sensitivity in the target direction, i.e. zero degree direction or look direction of the user, i.e. the heading as illustrated on FIG. 8. The maximum sensitivity in the target direction, or at least very close thereto, for example within an angular space from 350 degrees-10 degrees similar to the polar pattern of the first monaural directional signal 120. The third polar pattern exhibits a reduced sensitivity relative to the maximum sensitivity to incoming sound arriving from the ipsilateral side of the user's right ear and from the rear hemisphere of the user's head, i.e. at directions of about 180 degrees. The response or sensitivity of the third polar pattern may show a relative attenuation or suppression of incoming sound arriving from the ipsilateral side and rear of the user's right ear larger than 6 dB or 10 dB such as larger than 12 dB or even larger than 15 dB determined at 2 kHz using a narrowband test signal such as a sine wave. The response or sensitivity of the third polar pattern may exhibit the same relative attenuation of these off-axis sound signals within a broader frequency range for example as determined by a 1.5 kHz-5 kHz bandlimited white noise signal. The third monaural directional signal 121 is transmitted to the left ear hearing aid 16L over the wireless communication interface 34R and magnetic coil antenna 44R.

The second signal processor 24R is also configured to implement the functionality of the fourth monaural beamformer 205 which is configured to generate the fourth directional microphone signal 220. The fourth monaural directional signal 220 exhibits a fourth polar pattern with good sensitivity in the target direction and at the ipsilateral side of the user's right ear, determined at 2 kHz, using the angular convention for sound incidence indicated on FIG. 8. This substantially equal sensitivity in the target direction and at the ipsilateral side of the user's left ear preferably means that the response or sensitivity of the fourth polar pattern varies with less than 6 dB, more preferably less than 4 dB such as less than 3 dB, in the angular range between 180 degrees and 30 degrees determined at 2 kHz. This substantially equal sensitivity in the target direction and at the ipsilateral side of the user's right ear preferably means that the sensitivity of the fourth polar pattern varies with less than 6 dB, more preferably less than 4 dB such as less than 2 dB, for sound incidence directions or angular range between 180 degrees and 30 degrees determined at 2 kHz using a narrowband test signal such as a sine wave. The response or sensitivity of the fourth polar pattern may exhibit the same uniformity for the sound incidence between 180 and 30 degrees within a broader frequency range for example as determined by a 1.5 kHz-5 kHz bandlimited white noise signal. The second polar pattern may for example be substantially equal to the open ear directional response of KEMAR's right ear.

Figure 6B:
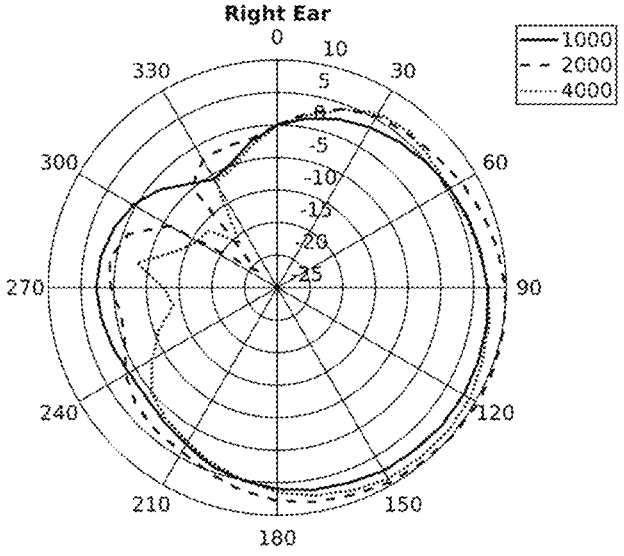
FIG. 6B shows a set of measured polar patterns of the fourth monaural directional signal generated by an exemplary embodiment of the fourth monaural beamformer at test frequencies 1, 2 and 4 kHz with the second hearing aid fitted on KEMAR's right ear.

The sensitivity of the fourth monaural directional signal 220 as reflected in the fourth polar pattern in the target direction, 360 or 0 degrees, may be about 4-10 dB lower than the sensitivity in the 90 degrees angle for the earlier discussed reasons. FIG. 6B shows a set of measured polar patterns of the fourth monaural directional signal 220 for one embodiment of the fourth monaural beamformer 215 at test frequencies 1, 2 and 4 kHz for an exemplary BTE hearing aid mounted at KEMAR's right. The sensitivity of the fourth monaural directional signal 123 in the target direction, 360 or 0 degrees, may be about 4-10 dB lower than the sensitivity in the 90 degrees direction to allow an appropriate sensitivity of the bilateral omnidirectional microphone signal, aka true-omnidirectional signal, in the target direction after mixing of the second monaural directional signal 123 and a fourth monaural directional signal. The skilled person will appreciate that the polar patterns of the second and fourth monaural directional signals 123, 220 may be substantially mirror-symmetric about the front-back axis or direction, i.e. from 0 to 180 degrees. The fourth monaural directional signal 220 possess a good sensitivity for incoming sound not just from the target direction, but also from a broad angular range about the ipsilateral side of the user's right ear. The skilled person will understand that the fourth polar pattern preferably is designed such that the sensitivity to sounds arriving at the user's contralateral ear, left ear in the illustrated embodiment, may be significantly smaller than the sensitivity to sounds arriving from the ipsilateral side of the user's left ear, determined at 2 kHz using a narrow-band test signal as illustrated on FIG. 6B.

The skilled person will understand that the fourth monaural beamformer 205 may be implemented as dedicated computational hardware integrated on the signal processor 24R or implemented by a first set of suitable executable program instructions executed on the signal processor 24R such as the previously discussed programmable microprocessor or DSP or any combination of dedicated computational hardware and executable program instructions. Likewise, the third monaural beamformer 215 may be implemented as dedicated computational hardware of the signal processor 24R or implemented by a second set of suitable executable program instructions executed on the signal processor 24R such as the previously discussed programmable microprocessor or DSP or any combination of dedicated computational hardware and executable program instructions.

The skilled person will understand that there exist numerous implementations of the second monaural beamformer 115 which create the second polar pattern of the second monaural directional signal 123 and likewise for the fourth monaural beamformer 205 which create the fourth polar pattern of the fourth monaural directional signal 220. In certain embodiments of the binaural hearing aid system, the second monaural beamformer 115 and the fourth monaural beamformer 205 are entirely omitted which saves computational resources and power consumption of the first signal processor 24L and the second signal processor 24R. The functionality of the second monaural beamformer 115 and the fourth monaural beamformer 205 are replaced by exploiting natural directional properties of the user's outer ears, e.g. pinnaes and ear canals, for the formation of the second monaural directional signal and the formation of the fourth monaural directional signal. The first hearing aid comprises least one housing portion shaped and sized for placement inside the user's left or right ear canal. The least one housing portion comprises an omnidirectional microphone of the first microphone arrangement with a sound inlet at an outwardly oriented surface of the least one housing portion. The second hearing aid comprises least one housing portion shaped and sized for placement inside the user's ear opposite ear canal. The least one housing portion comprises an omnidirectional microphone of the second microphone arrangement with a sound inlet at an outwardly oriented surface of the least one housing portion of the second hearing aid. The least one housing portion of the first hearing aid may be an individually shaped housing of an ITE, CIC or ITC hearing aid or and ear canal plug of an RIC type of hearing aid and the same for the least one housing portion of the second hearing aid.

According to exemplary embodiments of the second monaural beamformer 115 and fourth monaural beamformer 205, the first signal processor 24L is configured to generate the second monaural directional signal, dl (f, Ø), according to:

$$dl(f,\varnothing)=F_{fl}(f,b)*H_{fl}(f,\varnothing)+F_{bl}(f,a)*H_{bl}(f,\varnothing);$$

and the second signal processor 24R is configured to generate the fourth monaural directional signal, dr (f, Ø) of the second hearing aid according to:

$$dr(f,\varnothing)=F_{fr}(f,d)*H_{fr}(f,\varnothing)+F_{br}(f,c)*H_{br}(f,\varnothing)$$

wherein Ø represents an azimuth angle to the sound source and Ø=0 is the target direction, $H_{fl}$(f, Ø) represents a head related transfer function of the first microphone of the second hearing aid as measured on an acoustic manikin, such as KEMAR or HATS, $H_{bl}$(f, Ø) represents a head related transfer function of the second microphone of the second hearing aid as measured on an acoustic manikin, such as KEMAR or HATS, $H_{fr}$(f, Ø) represents a head related transfer function of the first microphone of the first hearing aid as measured on an acoustic manikin, such as KEMAR or HATS, $H_{br}$(f, Ø) represents a head related transfer function of the second microphone of the first hearing aid as measured on an acoustic manikin, such as KEMAR or HATS; and $F_{fl}$(f, b) represents a frequency response of a first discrete time filter, e.g. FIR filter, of the first hearing aid, $F_{bl}$(f, a) represents a frequency response of a second discrete time filter, e.g. FIR filter of the first hearing aid, $F_{fr}$(f, d) represents a frequency response of a first discrete time filter, e.g. FIR filter of the second hearing aid, $F_{br}$(f, c) represents a frequency response of a second discrete time filter, e.g. FIR filter, of the second hearing aid;

wherein respective sets of filter coefficients a, b, c and d are determined by minimizing the cost function:

$$\underset{a,b,c,d}{\mathrm{ARGmin}} \int\int \left( \begin{array}{c} w_o(f,\theta)*\big(trueOmniTarget(f,\theta)- \\ \max_p(\|P^l(f,\varnothing)\|,\|P^r(f,\varnothing)\|)\big)^2+ \\ w_{zeroL}(f)*((\|P^l(f,\varnothing)\|- \\ \|\mathrm{reference}(f,\varnothing l)\|)^2\,|_{\theta l=reference-directionLeftEar}+ \\ w_{zeroR}(f)*((\|P^r(f,\varnothing)\|- \\ \|\mathrm{reference}(f,\varnothing r)\|)^2\,|_{\theta r=reference-directionRightEar} \end{array} \right) df\,d\theta$$

wherein trueOmniTarget(f, θ) is a selected target function of the fifth polar pattern of the bilateral omnidirectional microphone signal;

$P^l$ is a frequency response of the second monaural directional signal;

$P^r$ is a frequency response of the fourth monaural directional signal; $w_o$, $w_{zeroL}$ and $w_{zeroR}$ are respective weight functions representing trade-off costs over frequency, and optionally sound source angles, between three components of the cost function.

The target function trueOmniTarget(f, θ) may be defined or selected by the designer or constructor of the present binaural or bilateral hearing aid system 50. The target function trueOmniTarget(f, θ) may be a "true" omnidirectional polar pattern having substantially equal sensitivity to incoming sound from all directions and across the audible frequency range. Alternatively, the target function trueOmniTarget(f, θ)) may corresponds to a maximum over the sensitivity of the left and right open ear responses for all directions and frequencies or any other appropriate another shape.

The variables $w_o$, $w_{zeroL}$ and $w_{zeroR}$ are weights representing trade-off costs between three components of the cost function, i.e. realizing the trueOmniTarget pattern while ensuring, within a certain tolerance, that both the second monaural directional signal, dl (f, Ø) of the left ear or right ear hearing aid and fourth monaural directional signal, dr (f, Ø) of opposite hearing aid possess a desired "reference" response in the target direction. The target direction is often 0 degrees azimuth, i.e. the look direction. The desired "reference" response is usually equal to a front microphone response in the reference direction. These weights of variables $w_o$, $w_{zeroL}$ and $w_{zeroR}$ can vary over sound incidence angle, i.e. direction, and frequency, expressing the relative importance of each objective at each point. The skilled person will understand that the second and fourth polar patterns of the second and fourth monaural directional signals, respectively, may be constrained to be substantially mirror images of each other. In this case, the discrete time filter filters a and c and the discrete time filters b and d are constrained to be the same.

The second signal processor 24R receives the second monaural directional signal 123 from the left ear hearing aid 16L over the wireless communication interface 34R and magnetic coil antenna 44R. The second monaural directional signal 123 is preferably time delayed relative to the fourth monaural directional signal 220 before or in connection with being processed by a scaling function 211 and applied to a signal mixer or combiner 217. The relative time delay of the second monaural directional signal 123 is schematically indicated by delay element t1 and includes an inherent transmission time delay of the second monaural directional signal 123 through the wireless communication link 12 and a time delay introduced by the second signal processor 24R to reach a target or desired time delay.

The relatively time-delayed second monaural directional signal 123 is applied to an input of a first scaling function 211 which applies a scaling factor β between 0 and 1 to the second monaural directional signal 123 before a scaled version of the latter is inputted to a signal mixer or combiner 217. The second monaural directional signal 123 is applied to an input of a first scaling function 211 which applies the scaling factor β which may be a scalar value between 0 and 1 to the second monaural directional signal 123 before a scaled version of the latter is inputted to a signal mixer or combiner 217. The fourth monaural directional signal 220 is transmitted through an optional time delay function 213, schematically indicated by delay t2, before being applied to an input of a second scaling function 213 which applies a scalar scaling factor (1-β) to the fourth monaural directional signal 220 before the scaled version of the latter signal is applied to a second input of the signal mixer or combiner 217. The scalar scaling factor β

The signal mixer or combiner 217 accordingly mixes the second monaural directional signal 123 and the fourth monaural directional signal 220 in a mixing ratio set by the value of the scalar scaling factor β to generate the bilateral omnidirectional microphone signal 219. The signal processor 24R may be configured to apply the bilateral omnidirectional microphone signal 219 to the previously discussed conventional hearing loss function or module 210 of the right side hearing aid 10R. The conventional hearing loss processor 210 is configured to compensate a hearing loss of the user's right ear and provides a hearing loss compensated output signal to the miniature loudspeaker or receiver 32R or in the alternative to multiple output electrodes of a cochlear implant type of output stage. The conventional hearing loss processor 210 and miniature loudspeaker or receiver 32R etc. may be identical to the corresponding components of the above-discussed left ear aid. The target or desired value of the time delay, t1, may be set to a value between 3 ms and 50 ms such as between 5 ms and 20 ms, wherein said time delay is determined at 2 kHz if the time delay varies across the audio frequency range from 100 Hz to 10 kHz.

The skilled person will understand that the time delay, scaling and mixing operation of the second monaural directional signal 123 and the fourth monaural directional signal 220 to generate the bilateral omnidirectional microphone signal 219 may formally be expressed as:

$$S=\beta*dr+(1-\beta)dl_{e2e}(t1);$$

wherein:

S: is a time-domain representation of the bilateral omnidirectional microphone signal 219;

dr: is a time-domain representation of the fourth monaural directional signal 220;

$dl_{e2e}(t1)$: is a time-domain representation of the second monaural directional signal 123 with a relative time delay of (t1), β: is the scalar scaling factor between 0 and 1 setting the mixing ratio of the second and fourth monaural directional signals.

Alternatively, β is a filter to set a frequency-dependent mixing ratio of the second and fourth monaural directional signals as discussed below.

The introduction of a relative time delay t1 between the second monaural directional signal 123 and the fourth monaural directional signal 220 leads to several important advantages of the bilateral omnidirectional microphone signal 219 such as providing good perceptual or auditory fusion between the second and fourth monaural directional signals 123, 220 due to the well-known Haas effect which is particularly pronounced for relative time delay t1 between 5 and 20 ms. Another advantage of the relative time delay t1 is its decorrelation of the second and fourth monaural directional signals 123, 220 and thereby minimizing signal cancellation effects when the second and fourth monaural directional signals 123, 220 are summed or added by the signal mixer or combiner 217.

Figure 9:
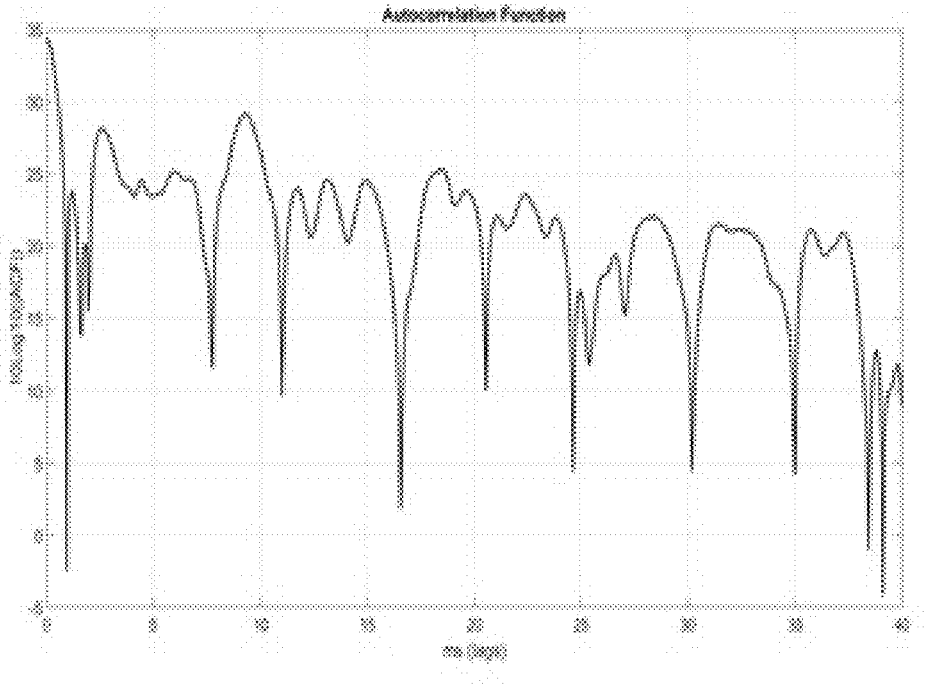
FIG. 9 illustrates schematically the autocorrelation function in dB of speech as function of time lag between speech signals measured in milliseconds (ms).

FIG. 9 illustrates how this relative time delay t1 serves to temporarily de-correlate the second and fourth monaural directional signals 123, 220 and shows the autocorrelation function in dB of speech as function of time lag between speech signals measured in milliseconds (ms). It is evident that the autocorrelation decreases as the time lag increases and that the autocorrelation of speech is reduced by about 10 dB for a time lag or around 5 ms.

Because the second monaural directional signal 123 is transmitted through the wireless communication link to the right ear hearing aid 16R there will be an inherent time delay of the second monaural directional signal 123 relative to the fourth monaural directional signal 220, or vice versa when the roles of the hearing aids are swapped, on at least the that transmission time delay. The skilled person will appreciate that if that transmission time delay exceeds the above-mentioned target delay between 3 ms and 50 ms, the second signal processor 24R may be configured to introduce a time delay to the fourth monaural directional signal 220 for example using the previously discussed second time delay element t2 and setting an appropriate time delay therein to compensate for the too long delay through the wireless communication link.

The scaling factor β may have a fixed scalar value, e.g. 0.5, in some embodiments. The scalar scaling factor β may be constrained to lie within a certain interval between 0 and 1 e.g. $</=0.5-\varepsilon$ or $>/=0.5+\varepsilon$ to reduce comb filter effects by the mixing or addition of the second and fourth monaural directional signals 123, 220 in the signal mixer or combiner 217. The parameter a can range from 0.1 to 0.3.

According to alternative embodiments, the scaling factor β is dynamically adjustable and its instantaneous value controlled by the second signal processor in accordance with predetermined properties of the second and fourth monaural directional signals 123, 220.

According to one such embodiment, the second signal processor is configured to adaptively adjust the scaling factor, β, in accordance with relative signal powers or signal levels of the second and fourth monaural directional signals 123, 220—for example by computing the scaling factor β in accordance with:

$$\beta = \frac{dl^2}{dl^2 + dr^2}$$

In one embodiment, β is computed by the schematically illustrated computational function, element or algorithm 214 of the second signal processor 24R which element 214 receives the second and fourth monaural directional signals 123, 220 as inputs as illustrated. The second signal processor 24R may be configured adjust β to maximize the power of the bilateral omnidirectional microphone signal 219. By exploiting the "reciprocal" relationship between β and (1−β) it is ensured that directional response of the bilateral omnidirectional microphone signal 219 in the target or reference direction, e.g. 0 degrees, is within a certain tolerance of the desired response in the reference direction.

The above-mentioned adaptive adjustment of the scaling factor, β, in accordance with relative signal powers or signal levels of the second and fourth monaural directional signals 123, 220 provides certain beneficial properties of the bilateral omnidirectional microphone signal 219 when the user is situated in a cocktail party type of sound environment or auditory scene where multiple sound sources exist simultaneously. Theoretically, if there is only one sound source in the sound environment, the second signal processor, could be adapted to pick-up or select the merely the one of the second and fourth monaural directional signals 123, 220 with the larger power as the the bilateral omnidirectional microphone signal 219. However, in a cocktail party scenario, there are multiple sound sources distributed around the user and selecting the maximum total power of the second and fourth monaural directional signals 123, 220 does not guarantee optimal audibility for every sound source. Therefore, the above-mentioned weighted average of the second and fourth monaural directional signals 123, 220 in accordance with their relative levels provides a good trade-off to take care of a variety of sound environments. It is also clear that the selection of the value of β gives more weight to the stronger signal because when $dl^2 \gg dr^2, \beta \rightarrow 1$ and the bilateral omnidirectional microphone signal 219 is primarily composed of the second monaural directional signal 123 and vice versa when $dr^2 \gg dl^2$.

The dynamically adjustable value of the scalar scaling factor β is useful because if β is fixed e.g. at 0.5 and the user is situated in a sound environment with just a single sound source, e.g. at the left side of the user's head, this 0.5 value of β will reduce the incoming sound by 6 dB when presented by the bilateral omnidirectional microphone signal 219 which applied to the user's right ear. At the user's left ear, which receives the bilateral beamformed signal 109, the sound source will be strongly attenuated or suppressed due to the high directivity of the bilateral beamformer. In contrast, when the scalar scaling factor β is adaptively adjusted in accordance with relative signal powers or signal levels of the second and fourth monaural directional signals 123, 220 β it will go to about 1 so that is presented unattenuated in the bilateral omnidirectional microphone signal 219.

The skilled person will also appreciate that the value of β will go to about 0.5 when the user, wearing the present binaural or bilateral hearing aid system 50, is situated in a diffuse sound field because the incoming sound pressures at the left-ear and right ear hearing aid are substantially equal which means that the second monaural directional signal 123 and fourth monaural directional signal 220 preferably have about equal power. The skilled person will understand the determination of the respective powers or levels of the second and fourth monaural directional signals 123, 220 preferably is carried using a certain signal averaging time or integration time and that this integration or smoothing determines how rapidly the composition of the bilateral omnidirectional microphone signal 219 changes. The integration time used for determining the power or level of the second monaural directional signals 123 is preferably between 2 ms and 10 ms and the same range for the fourth monaural directional signal 220 since this range will allow the bilateral omnidirectional microphone signal 219 capture speech onsets. However, the integration time could be significantly longer for example exceeding 50 ms in other embodiments.

According to another embodiment β is filter such as a FIR filter or IIR filter. Thereby, a dynamic adjustment of the scaling factor β allows a different amount of mixing between the second and fourth monaural directional signals 123, 220 over the entire, or at least sub-range, of the audible frequency range.

The scaling factor β may comprise a linear phase FIR filter with a group delay of d samples. The second signal processor 24R, or the first signal processor 24L depending on the respective roles of the first and second hearing aids in the system, may be configured to maximize the power of the bilateral omnidirectional microphone signal 219, denoted S, in accordance with:

$$S = \beta * dr + (z^{-d} - \beta) dl_{e2e}(t1)$$

The second signal processor 24R may for example be configured to adaptively adjust coefficients of the FIR digital filter to maximize the power of the bilateral omnidirectional microphone signal 219 across frequency. The second signal processor 24R may apply any suitable optimization algorithm such as an LMS or NLMS algorithm to carry out the adaptive adjustment of the FIR digital filter.

Figure 7:
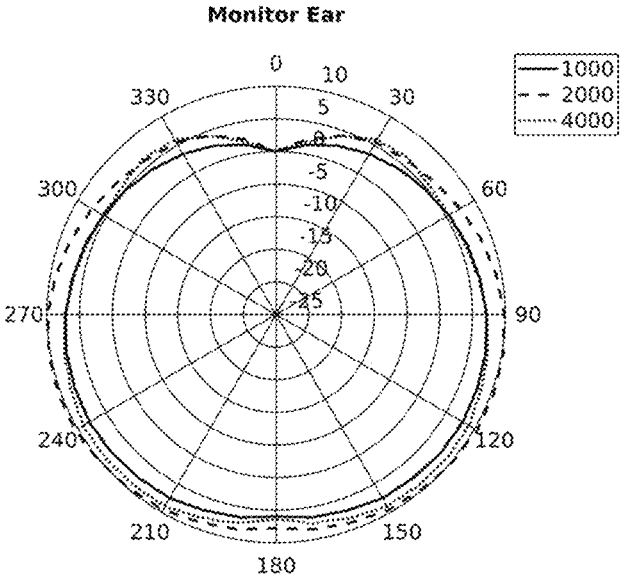
FIG. 7 shows a set of measured polar patterns of the bilateral omnidirectional microphone signal based on the second and fourth monaural directional signals at test frequencies 1, 2 and 4 kHz with the second hearing aid fitted on KEMAR's right ear.

FIG. 7 shows a set of measured polar patterns of the bilateral omnidirectional microphone signal 219 based on a mixing of the second and fourth monaural directional signals 123, 220 at test frequencies 1, 2 and 4 kHz with the binaural hearing aid system fitted on KEMAR's left and right ears. The bilateral omnidirectional microphone signal 219 is generated using a fixed scalar scaling factor β of 0.5.

Figure 4:
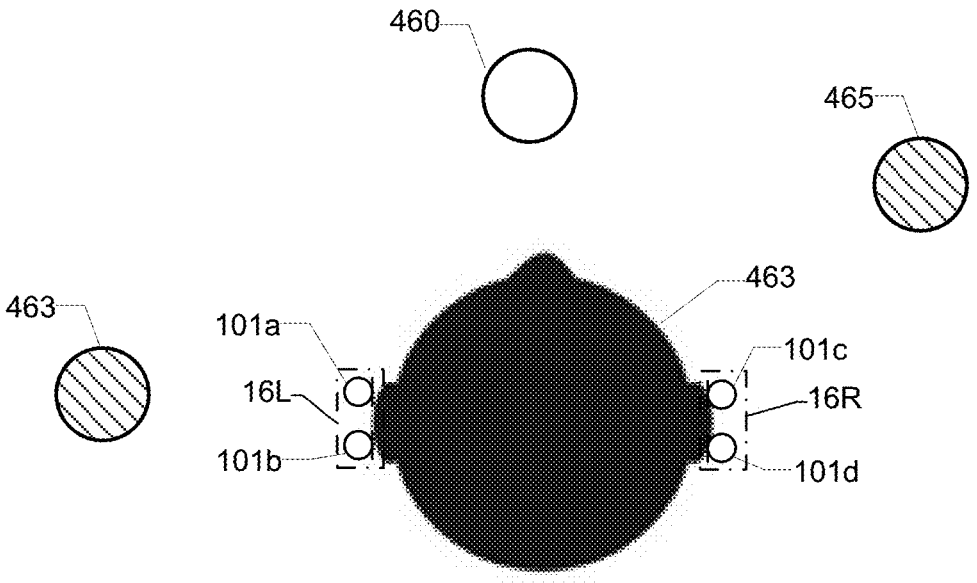
FIG. 4 is a schematic illustration of a hearing impaired individual fitted with a binaural or bilateral hearing aid system in accordance with exemplary embodiments.

FIG. 4 is a schematic illustration of a hearing impaired individual 463 fitted with a binaural or bilateral hearing aid system comprising first and second hearing aids 16L, 16R mounted at the user's left and right ears. The illustrative sound source arrangement or setup comprises a target sound source 460, e.g. a desired speaker, placed in a target direction at 0 degrees azimuth. The sound source arrangement may include one or more interfering sound sources 463, 465 arranged around the user's head at various off-axis directions, i.e. outside the target direction.

Figure 5:
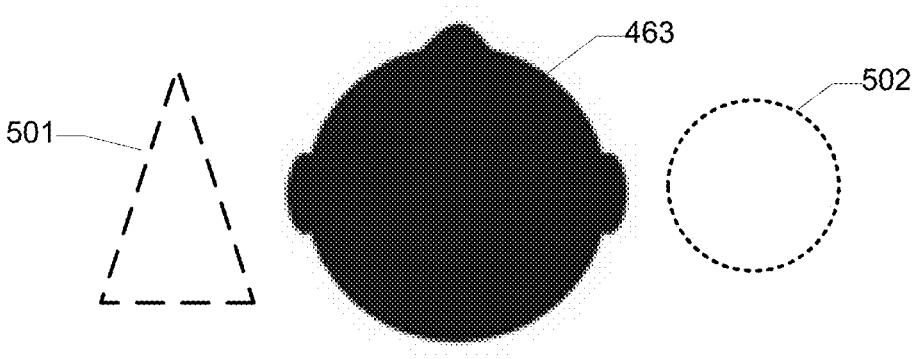
FIG. 5 is a schematic illustration of the properties of the bilaterally beamformed signal the bilateral omnidirectional microphone signal generated by exemplary embodiments of the bilateral hearing aid system.

FIG. 5 is a schematic illustration of the high directivity index of the bilaterally beamformed signal 501 applied to the user's left ear and the relatively much lower directivity index of the bilateral omnidirectional microphone signal 502 applied to the user's right ear by exemplary embodiments of the bilateral hearing aid system.

As used in this specification, the term "microphone arrangement" may refer to one or more microphones, such as a microphone system having one or more microphones.

Also, as used in this specification, unless otherwise specifically defined, the term "substantially equal" refers to two items or parameters having respective features, attributes, or values that do not vary by more than 30%, or that do not vary by more than 20%, or that do not vary by more than 10%, or that do not vary by more than 5%.

Although features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications, and equivalents.

The invention claimed is:

1. A binaural hearing aid system comprising:

a first hearing aid for placement at, or in, a first ear of a user, the first hearing aid comprising a first microphone arrangement, a first signal processor, and a first bidirectional data communication interface;

a second hearing aid for placement at, or in, a second ear of the user, the second hearing aid comprising a second microphone arrangement, a second signal processor, and a second bidirectional data communication interface;

wherein the first hearing aid is configured to:

generate a first monaural directional signal based on one or more microphone signals supplied by the first microphone arrangement, the first monaural directional signal having a first polar pattern with a maximum sensitivity in a target direction, a reduced sensitivity at an ipsilateral side of the first hearing aid, and a reduced sensitivity at a contralateral side of the first hearing aid, generate a second monaural directional signal based on the one or more microphone signals supplied by the first microphone arrangement, the second monaural directional signal exhibiting a second polar pattern with substantially equal sensitivity in the target direction and at the ipsilateral side of the first hearing aid, transmit the second monaural directional signal from the first hearing aid to the second hearing aid through the first bidirectional data communication interface, receive a third monaural directional signal from the second hearing aid through the first bidirectional data communication interface, generate a bilaterally beamformed signal based on the first and third monaural directional signals, the bilaterally beamformed signal having a polar pattern with a maximum sensitivity in the target direction, a reduced sensitivity at the ipsilateral side of the first hearing aid, and a reduced sensitivity at the contralateral side of the first hearing aid, apply the bilaterally beamformed signal for providing a first audible signal for the first ear; and wherein the second hearing aid is configured to:

receive the second monaural directional signal from the first hearing aid through the second bidirectional data communication interface, generate the third monaural directional signal based on one or more microphone signals supplied by the second microphone arrangement, the third monaural directional signal having a third polar pattern with a maximum sensitivity in the target direction, a reduced sensitivity at an ipsilateral side of the second hearing aid, and a reduced sensitivity at a contralateral side of the second hearing aid, transmit the third monaural directional signal to the first hearing aid through the second bidirectional data communication interface, generate a fourth monaural directional signal based on the one or more microphone signals supplied by the second microphone arrangement, mix the second and fourth monaural directional signals according to a fixed or adjustable ratio to generate a bilateral omnidirectional microphone signal exhibiting a fifth polar pattern in accordance with the second and fourth polar patterns, and apply the bilateral omnidirectional microphone signal for providing a second audible signal for the second ear.

2. The binaural hearing aid system according to claim 1, wherein the second monaural directional signal is time delayed relative to the fourth monaural directional signal before the second hearing aid mixes the second and fourth monaural directional signals.

3. The binaural hearing aid system according to claim 2, wherein the time delay is between 3 ms and 50 ms.

4. The binaural hearing aid system according to claim 3, wherein the time delay has a value that is determined at 2 kHz.

5. The binaural hearing aid system according to claim 1, wherein the second hearing aid is configured to generate the bilateral omnidirectional microphone signal according to: $S=\beta*dl+(1-\beta)dr_{e2e}(t1)$;

wherein:

S is a time-domain representation of the bilateral omnidirectional microphone signal based on a mixture of the second and fourth monaural directional signals;

dl is a time-domain representation of the fourth monaural directional signal;

$dr_{e2e}(t1)$ is a time-domain representation of the second monaural directional signal with a relative time delay of (t1); and β is scaling factor having a scalar value between 0 and 1 setting a mixing ratio of the second and fourth monaural directional signals, or is a filter to set a frequency-dependent mixing ratio of the second and fourth monaural directional signals.

6. The binaural hearing aid system according to claim 5, wherein the second signal processor of the second hearing aid is configured to adaptively adjust the scaling factor β based on relative powers of the second and fourth monaural directional signals.

7. The binaural hearing aid system according to claim 5, wherein the second signal processor of the second hearing aid is configured to adaptively adjust the scaling factor β, or to adaptively adjust coefficients of the filter, to maximize power of the bilateral omnidirectional microphone signal.

8. The binaural hearing aid system according to claim 5, wherein the filter comprises a digital filter.

9. The binaural hearing aid system according to claim 8, wherein the digital filter comprises a frequency dependent filter.

10. The binaural hearing aid system according to claim 8, wherein the digital filter comprises a FIR filter or an IIR filter.

11. The binaural hearing aid system according to claim 1, wherein the second hearing aid is configured to generate the bilateral omnidirectional microphone signal according to:

$$S=\beta*dl+(z^{-d}-\beta)dr_{e2e}(t1).$$

wherein:

S is a time-domain representation of the bilateral omnidirectional microphone signal based on a mixture of the second and fourth monaural directional signals;

dl is a time-domain representation of the fourth monaural directional signal;

$dr_{e2e}(t1)$ is a time-domain representation of the second monaural directional signal with a relative time delay of (t1);

β is scaling factor having a scalar value between 0 and 1 setting a mixing ratio of the second and fourth monaural directional signals, or is a filter to set a frequency-dependent mixing ratio of the second and fourth monaural directional signals; and d is a group delay of a linear phase FIR filter.

12. The binaural hearing aid system according to claim 1, wherein the first hearing aid comprises a first housing portion shaped and sized for placement inside a first ear canal of the user, and an omnidirectional microphone of the first microphone arrangement, the omnidirectional microphone of the first microphone arrangement having a first sound inlet at an outwardly oriented surface of the first housing portion such that the second polar pattern of the second monaural directional signal is at least partly formed by natural directional properties of a first pinna of the user.

13. The binaural hearing aid system according to claim 12, wherein the second hearing aid comprises a second housing portion shaped and sized for placement inside a second ear canal of the user, and an omnidirectional microphone of the second microphone arrangement, the omnidirectional microphone of the second microphone arrangement having a second sound inlet at an outwardly oriented surface of the second housing portion such that the fourth polar pattern of the fourth monaural directional signal is at least partly formed by natural directional properties of a second pinna of the user.

14. The binaural hearing aid system according to claim 1, wherein the first hearing aid comprises a first housing portion configured for placement at or behind a first ear pinna of the user, the first housing portion comprising first and second omnidirectional microphones of the first microphone arrangement arranged with respective sound inlets spaced apart by a first predetermined distance; and wherein the first signal processor is configured to apply a first beamforming algorithm to the first and second microphone signals supplied by the first and second omnidirectional microphones to generate the first monaural directional signal, and apply a second beamforming algorithm to the first and second microphone signals supplied by the first and second omnidirectional microphones to generate the second monaural directional signal.

15. The binaural hearing aid system according to claim 14, wherein the second hearing aid comprises a second housing portion configured for placement at or behind a second ear pinna of the user, the second housing portion comprising first and second omnidirectional microphones of the second microphone arrangement arranged with respective sound inlets spaced apart by a second predetermined distance; and wherein the second signal processor is configured to apply a third beamforming algorithm to the first and second microphone signals supplied by the first and second omnidirectional microphones of the second microphone arrangement to generate the third monaural directional signal, and apply a fourth beamforming algorithm to the first and second microphone signals supplied by the first and second omnidirectional microphones of the second microphone arrangement to generate the fourth monaural directional signal.

16. The binaural hearing aid system according to claim 1, wherein the first signal processor is further configured to adaptively compute the bilaterally beamformed signal based on a cost function C(α,β) according to:

$$C(\alpha,\beta)=\{E\{(\alpha Z_l+\beta Z_r)\cdot(\alpha Z_l^*+\beta Z_r^*)\}+\lambda*(\alpha+\beta-1)+\lambda(\alpha+\beta-1)^*$$

under constraint α+β=1, and wherein:

E represents statistical expectation, $dl_i$ represents the i-th subband of the first monaural directional signal, $dr_i$ represents the i-th subband of the third monaural directional signal; and

* indicates a conjugation of a complex function.

17. The binaural hearing aid system according to claim 1, wherein the first signal processor is configured to generate the second monaural directional signal dl (f, Ø), according to:

$$dl(f,\varnothing)=F_{fl}(f,b)*H_{fl}(f,\varnothing)+F_{bl}(f,a)*H_{bl}(f,\varnothing);$$

wherein the second signal processor is configured to generate the fourth monaural directional signal dr (f, Ø) according to:

$$dr(f,\varnothing)=F_{fr}(f,d)*H_{fr}(f,\varnothing)+F_{br}(f,c)*H_{br}(f,\varnothing);$$

wherein Ø represents an angle with respect to a sound source, with Ø=0 representing the target direction;

wherein $H_{fl}(f, \varnothing)$ represents a head related transfer function of a first microphone of the second hearing aid;

wherein $H_{bl}(f, \varnothing)$ represents a head related transfer function of a second microphone of the second hearing aid;

wherein $H_{fr}(f, \varnothing)$ represents a head related transfer function of a first microphone of the first hearing aid;

wherein $H_{br}(f, \varnothing)$ represents a head related transfer function of a second microphone of the first hearing aid;

wherein $F_{fl}$ (f, b) represents a frequency response of a first discrete time filter of the first hearing aid;

wherein $F_{bl}$(f, a) represents a frequency response of a second discrete time filter of the first hearing aid;

wherein $F_{fr}$(f, d) represents a frequency response of a first discrete time filter of the second hearing aid;

wherein $F_{br}$ (f, c) represents a frequency response of a second discrete time filter of the second hearing aid;

wherein respective sets of filter coefficients a, b, c and d are determined by minimizing a cost function:

$$\underset{a,b,c,d}{\mathrm{ARGmin}}\int\int\left(\begin{array}{c} w_o(f,\theta)*\big(trueOmniTarget(f,\theta)- \\ \max_p(\|P^l(f,\phi)\|,\|P^r(f,\phi)\|)\big)^2+ \\ w_{zeroL}(f)*((\|P^l(f,\phi)\|- \\ \|\mathrm{reference}(f,\phi l)\|)^2\,|_{\theta l=reference-directionLeftEar}+ \\ w_{zeroR}(f)*((\|P^r(f,\phi)\|- \\ \|\mathrm{reference}(f,\phi r)\|)^2\,|_{\theta r=reference-directionRightEar} \end{array}\right)df\,d\theta$$

wherein trueOmniTarget(f, θ) is a selected target function of the fifth polar pattern;

wherein $P^l$ is a frequency response of the second monaural directional signal;

wherein $P^r$ is a frequency response of the fourth monaural directional signal; and wherein $w_o$, $w_{zeroL}$ and $w_{zeroR}$ are respective weight functions.

18. The binaural hearing aid system according to claim 1, wherein the first signal processor of the first hearing aid is configured to perform hearing loss compensation of the bilaterally beamformed signal, and wherein the second signal processor of the second hearing aid is configured to perform hearing loss compensation of the bilateral omnidirectional microphone signal.

19. The binaural hearing aid system according to claim 1, wherein the first hearing aid comprises a miniature speaker, a receiver, or a stimulus electrode; and wherein the first hearing aid is configured to apply the bilaterally beamformed signal via an output amplifier to the miniature speaker, the receiver, or the stimulus electrode.

20. The binaural hearing aid system according to claim 1, wherein the fourth monaural directional signal exhibits a fourth polar pattern with substantially equal sensitivity in the target direction and at the ipsilateral side of the second hearing aid.

21. A method performed by a binaural hearing aid system comprising:

generating, by a first hearing aid, a first monaural directional signal based on one or more microphone signals supplied by a first microphone arrangement of the first hearing aid, the first monaural directional signal having a first polar pattern with a maximum sensitivity in a target direction, a reduced sensitivity at an ipsilateral side of the first hearing aid, and a reduced sensitivity at a contralateral side of the first hearing aid;

generating, by the first hearing aid, a second monaural directional signal based on the one or more microphone signals supplied by the first microphone arrangement, the second monaural directional signal exhibiting a second polar pattern with substantially equal sensitivity in the target direction and at the ipsilateral side of the first hearing aid;

transmitting the second monaural directional signal by the first hearing aid for reception by the second hearing aid;

receiving, by the second hearing aid, the second monaural directional signal;

generating, by the second hearing aid, a third monaural directional signal based on one or more microphone signals supplied by the second microphone arrangement, the third monaural directional signal having a third polar pattern with a maximum sensitivity in the target direction and a reduced sensitivity at an ipsilateral side of the second hearing aid;

transmitting, by the second hearing aid, the third monaural directional signal for reception by the first hearing aid;

receiving, by the first hearing aid, the third monaural directional signal;

generating, by the first hearing aid, a bilaterally beamformed signal based on the first and third monaural directional signals, the bilaterally beamformed signal having a polar pattern with a maximum sensitivity in the target direction, a reduced sensitivity at the ipsilateral side of the first hearing aid, and a reduced sensitivity at the contralateral side of the first hearing aid;

generating, by the second hearing aid, a fourth monaural directional signal based on the one or more microphone signals supplied by the second microphone arrangement, the fourth monaural directional signal exhibiting a fourth polar pattern with substantially equal sensitivity in the target direction and at the ipsilateral side of the second hearing aid;

mixing, by the second hearing aid, the second and fourth monaural directional signals in a fixed or adjustable ratio to generate a bilateral omnidirectional microphone signal exhibiting a fifth polar pattern;

converting, by the first hearing aid, the bilaterally beamformed signal into a first audible signal for the first ear; and converting, by the second hearing aid, the bilateral omnidirectional microphone signal into a second audible signal for the second ear.

* * * * *